US011187083B2

(12) United States Patent
Stauter et al.

(10) Patent No.: US 11,187,083 B2
(45) Date of Patent: Nov. 30, 2021

(54) HVAC FAN

(71) Applicant: Carrier Corporation, Palm Beach Gardens, FL (US)

(72) Inventors: Richie C. Stauter, Fayetteville, NY (US); Ryan K. Dygert, Cicero, NY (US); Mina Adel Zaki, Syracuse, NY (US); Daniel Asselin, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 200 days.

(21) Appl. No.: 16/405,656

(22) Filed: May 7, 2019

(65) Prior Publication Data

US 2020/0355079 A1 Nov. 12, 2020

(51) Int. Cl.

| | |
|---|---|
| ***F01D 5/14*** | (2006.01) |
| ***F04D 25/12*** | (2006.01) |
| ***F24F 7/06*** | (2006.01) |
| ***F24F 13/20*** | (2006.01) |

(52) U.S. Cl.
CPC ..... *F01D 5/141* (2013.01); *F04D 25/12* (2013.01); *F24F 7/06* (2013.01); *F24F 13/20* (2013.01); *F24F 2013/205* (2013.01)

(58) Field of Classification Search
CPC ..... F01D 5/141; F04D 25/12
USPC ..... 416/236 R
See application file for complete search history.

(56) References Cited

U.S. PATENT DOCUMENTS

| | | | |
|---|---|---|---|
| 4,089,618 A | 5/1978 | Patel | |
| 5,603,607 A | 2/1997 | Kondo et al. | |
| 6,296,446 B1 | 10/2001 | Ishijima et al. | |
| 7,815,418 B2 | 10/2010 | Suzuki et al. | |
| 8,512,004 B2 | 8/2013 | Nakagawa et al. | |
| 8,556,587 B2 | 10/2013 | Suzuki et al. | |
| 8,721,280 B2 | 5/2014 | Nakagawa et al. | |
| 8,915,717 B2 | 12/2014 | Stephan et al. | |
| 9,121,294 B2 | 9/2015 | Kray et al. | |
| 9,353,628 B2 * | 5/2016 | Gallagher | F04D 29/384 |
| 9,518,585 B2 | 12/2016 | Choi et al. | |

(Continued)

FOREIGN PATENT DOCUMENTS

| | | |
|---|---|---|
| CN | 201574972 | 9/2010 |
| CN | 102022381 | 4/2011 |

(Continued)

OTHER PUBLICATIONS

Stephan, EP2466150A2 English Translation, 2012 (Year: 2012).*

(Continued)

*Primary Examiner* — Michael L Sehn

(74) *Attorney, Agent, or Firm* — Carlson, Gaskey & Olds, P.C.

(57) ABSTRACT

A fan for a climate control outdoor unit includes a plurality of airfoils located around a central hub. Each of the airfoils includes a leading edge and a trailing edge opposite the leading edge. A pressure side surface extends between the leading edge and the trailing edge. A suction side surface is opposite the pressure side surface and extends between the leading edge and the trailing edge. The leading edge includes a greatest negative deviation from a radial line of greater than 10% of a span of the airfoil. The greatest negative deviation is located at between 45% and 85% of the span of the airfoil.

22 Claims, 10 Drawing Sheets

(56) References Cited

U.S. PATENT DOCUMENTS

| | | | |
|---|---|---|---|
| 9,556,881 | B2 | 1/2017 | Seiji et al. |
| 9,790,797 | B2 * | 10/2017 | Gallagher ..... F01D 5/141 |
| 2006/0285295 | A1 | 12/2006 | Ko et al. |
| 2012/0243975 | A1 | 9/2012 | Breeze-Stingfellow et al. |
| 2013/0091888 | A1 | 4/2013 | Park et al. |
| 2013/0323062 | A1 | 12/2013 | Henner et al. |
| 2014/0147282 | A1 | 5/2014 | Hu et al. |
| 2015/0152875 | A1 | 6/2015 | Kamiya et al. |
| 2017/0023005 | A1 | 1/2017 | Gallagher |
| 2017/0167275 | A1 | 6/2017 | Schroeder et al. |
| 2017/0261000 | A1 | 9/2017 | Komura et al. |
| 2018/0066521 | A1 | 3/2018 | Sawada |
| 2018/0238343 | A1 | 8/2018 | Nakashima et al. |
| 2018/0355885 | A1 | 12/2018 | Kim et al. |
| 2019/0024674 | A1 | 1/2019 | Loercher et al. |

FOREIGN PATENT DOCUMENTS

| | | | |
|---|---|---|---|
| CN | 301873335 | S | 3/2012 |
| CN | 204175642 | | 2/2015 |
| CN | 204572556 | | 8/2015 |
| CN | 106560115 | | 4/2017 |
| CN | 106837871 | | 6/2017 |
| CN | 107143521 | | 9/2017 |
| CN | 206530537 | | 9/2017 |
| CN | 206785722 | | 12/2017 |
| CN | 108087334 | | 5/2018 |
| CN | 207333287 | | 5/2018 |
| CN | 108167224 | | 6/2018 |
| CN | 208185056 | | 12/2018 |
| CN | 109469644 | A | 3/2019 |
| EP | 0569863 | | 11/1993 |
| EP | 2466150 | A2 | 6/2012 |
| EP | 2947330 | | 11/2015 |
| EP | 3217018 | | 9/2017 |
| JP | H1068537 | | 3/1998 |
| JP | 2000110785 | | 4/2000 |
| JP | 2003184792 | A | 7/2003 |
| JP | 2016205399 | A | 12/2016 |
| KR | 20140039976 | A | 4/2014 |
| KR | 101392610 | B1 | 5/2014 |
| KR | 20180013514 | A | 2/2018 |
| WO | 2011128533 | | 9/2011 |
| WO | 2015126449 | | 8/2015 |
| WO | 2019015729 | A1 | 1/2019 |
| WO | 2019021468 | A1 | 1/2019 |

OTHER PUBLICATIONS

Extended European Search Report for EP Application No. 20172603.1 dated Oct. 6, 2020.

SG Search Report and Written Opinion Report for SG Application No. 10202004155V English Translation Nov. 23, 2020.

* cited by examiner

HVAC FAN

BACKGROUND

This disclosure relates to HVAC fan inlets. More particularly, this disclosure relates to HVAC fans receiving inlet air flow.

A typical residential climate control (air conditioning and/or heat pump) system has an outdoor unit including a compressor, a refrigerant-air heat exchanger (coil), and an electric fan for driving an air flow across the heat exchanger. The outdoor unit will often include an inverter for powering the compressor motor and/or fan motor.

In one basic outdoor unit configuration, the outdoor unit has a generally square footprint with the heat exchanger wrapping around four sides and three corners of that footprint between two headers. The compressor is positioned within a central cavity surrounded by the heat exchanger on a base of the unit. A service panel of the housing is mounted aligned with the gap and carries the inverter. The fan is mounted atop the outdoor unit and draws air inward through the heat exchanger to the central cavity and then exhausts it upward.

SUMMARY

In one exemplary embodiment, a fan for a climate control outdoor unit includes a plurality of airfoils located around a central hub. Each of the airfoils includes a leading edge and a trailing edge opposite the leading edge. A pressure side surface extends between the leading edge and the trailing edge. A suction side surface is opposite the pressure side surface and extends between the leading edge and the trailing edge. The leading edge includes a greatest negative deviation from a radial line of greater than 10% of a span of the airfoil. The greatest negative deviation is located at between 45% and 85% of the span of the airfoil.

In a further embodiment of the above, the greatest negative deviation from the radial line is greater than 15% of the span.

In a further embodiment of any of the above, the greatest negative deviation from the radial line is located at between 60% and 80% of the span.

In a further embodiment of any of the above, the airfoil at 0% of the span of the airfoil includes a negative deviation from the radial line of between 0% and 5% of the span of the airfoil.

In a further embodiment of any of the above, the greatest negative deviation defines a convex profile of the leading edge with respect to the pressure side surface. The leading edge includes a concave profile with respect to the pressure side surface located adjacent the central hub.

In a further embodiment of any of the above, the concave profile of the leading edge is centered at between 10% and 30% of the span of the airfoil.

In a further embodiment of any of the above, the leading edge includes a downstream extending concavity and an upstream extending concavity. The downstream extending concavity is located radially inward of the upstream extending concavity.

In a further embodiment of any of the above, an inflection point between the downstream extending concavity and the upstream extending concavity is located at between 15% and 50% of the span of the airfoil.

In a further embodiment of any of the above, the airfoil includes a tip fence that extends between the leading edge and the trailing edge of the airfoil. The tip fence has a concave profile that extends along the pressure side surface of the airfoil.

In a further embodiment of any of the above, a tip section is located outward of 90% of the span of the airfoil and includes a negative deviation of between 5% and 10% of the span from the radial line.

In another exemplary embodiment, a fan housing assembly includes a housing that defines an inlet and a diffuser that is located fluidly downstream of the inlet. A fan is located within the fan housing and has a plurality of airfoils located around a central hub. Each of the airfoils includes a leading edge and a a trailing edge opposite the leading edge. A pressure side surface extends between the leading edge and the trailing edge. A suction side surface is opposite the pressure side surface and extends between the leading edge and the trailing edge. The leading edge includes a greatest negative deviation from a radial line of greater than 10% of a span of the airfoil. The greatest negative deviation is located at between 45% and 85% of the span of the airfoil.

In a further embodiment of any of the above, the diffuser is a diverging diffuser and the inlet includes a plurality of lobes separated by a corresponding recessed portion.

In a further embodiment of any of the above, a downstream extending concavity is along the leading edge of the airfoil. An upstream extending concavity is along the leading edge of the airfoil. The downstream extending concavity is located radially inward of the upstream extending concavity.

In a further embodiment of any of the above, the greatest negative deviation from the radial line is greater than 15% of the span.

In a further embodiment of any of the above, the greatest negative deviation from the radial line is located at between 60% and 80% of the span.

In a further embodiment of any of the above, the airfoil at 0% the span of the airfoil includes a negative deviation from the radial line of between 0% and 5% of the span of the airfoil.

In a further embodiment of any of the above, the greatest negative deviation defines a convex profile of the leading edge with respect to the pressure side surface. The leading edge includes a concave profile with respect to the pressure side surface located adjacent the central hub.

In a further embodiment of any of the above, the concave profile of the leading edge is centered at between 10% and 30% of the span of the airfoil.

In a further embodiment of any of the above, the airfoil includes a tip fence that extends between the leading edge and the trailing edge of the airfoil. The tip fence has a concave profile that extends along the pressure side surface of the airfoil.

In a further embodiment of any of the above, a tip section is located outward of 90% of the span of the airfoil and includes a negative deviation of between 5% and 10% of the span from the radial line.

DETAILED DESCRIPTION

In this and other heating, ventilation, and air conditioning (HVAC) applications where a heat exchanger (coil) is upstream of the fan, the fan performance becomes highly dependent on the flow through the coil, the coil configuration, the coil characteristics, and the coil distance relative to the fan inlet. This generally results in a non-uniform acceleration of the inlet flow going into the fan and with the use of a planar fan inlet, this will lead to flow separation, increase of fan power, and increase of fan noise. One example application is the residential heat pump outdoor unit where the non-circular nature of the heat exchanger footprint imposes circumferential asymmetries on the inlet flow.

Figure 1:
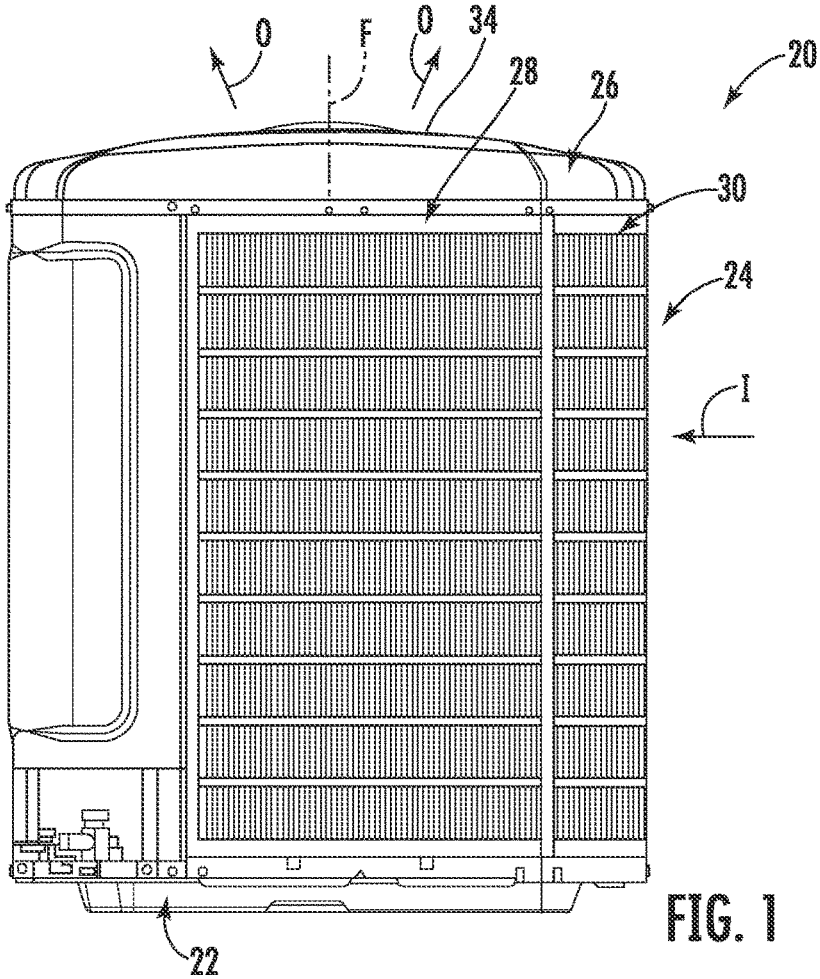
FIG. 1 is a side view of an outdoor unit for a heat pump system.
Figure 2:
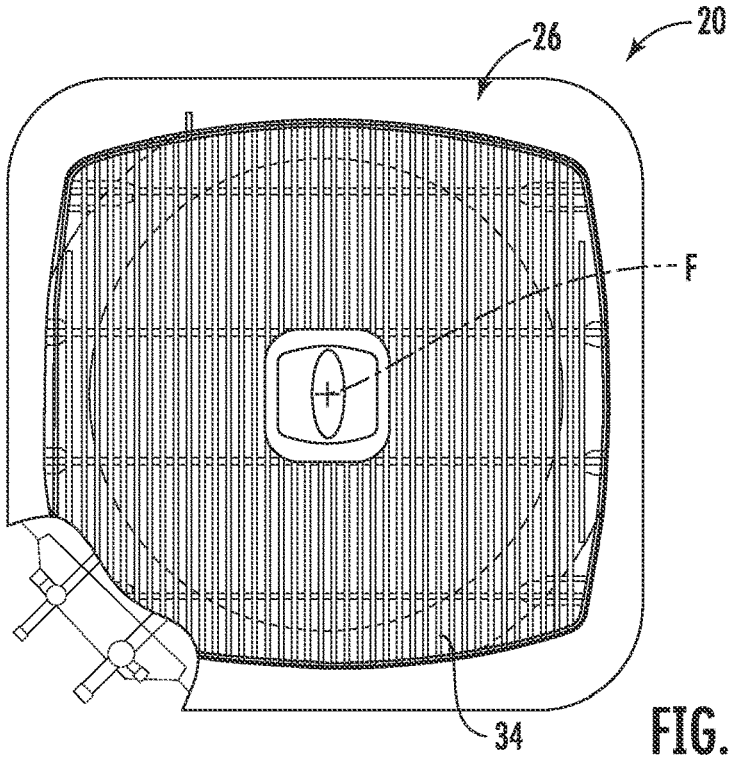
FIG. 2 is a top view of the outdoor unit of FIG. 1.

FIG. 1 illustrates an example outdoor unit 20. The outdoor unit 20 includes a base (base pan) 22 of a generally square (e.g., with rounded or faceted corners) planform. The base pan 22 supports the remainder of the components in the outdoor unit 20. Alternative coils can be of other planforms such as non-square rectangles or triangles of other polygons. Yet other coils may be oriented differently (e.g., V-coils where the shroud is above the V).

Figure 3:
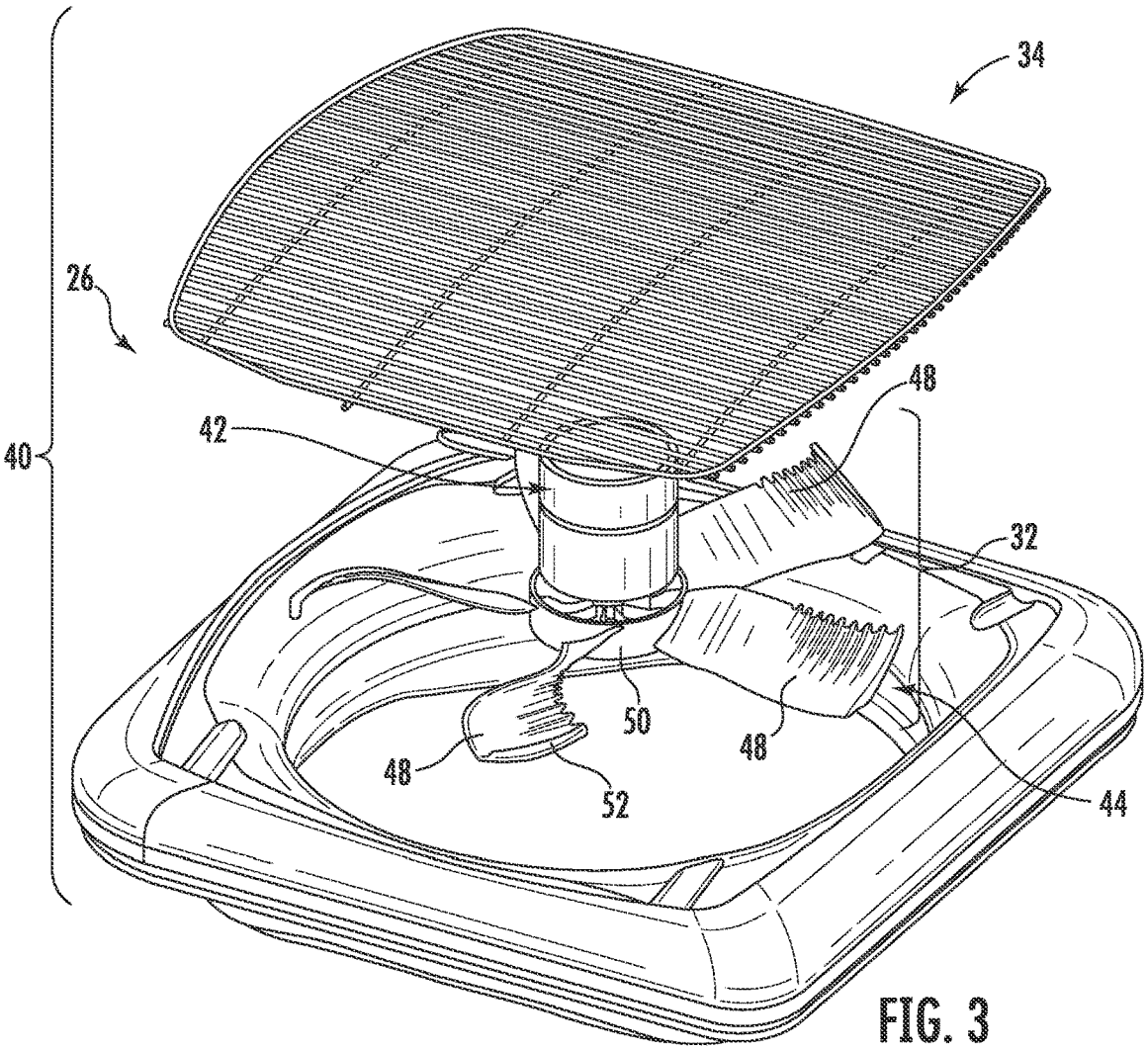
FIG. 3 is a vertically exploded view of a fan housing assembly.

The base pan 22 forms a base portion of a housing 24 and a top cover assembly 26 forms an upper portion of the housing 24. Along the lateral perimeter, the housing 24 includes one or more louvered panels 28 and/or corner posts 30 (also shown louvered in the illustrated example) or other structural members may connect the base pan 22 to the top cover assembly 26. In the illustrated example, the top cover assembly 26 supports a fan assembly 32 (FIG. 3). The exemplary fan assembly 32 defines a central vertical axis F shared with the remainder of the outdoor unit 20. A top of the top cover assembly 26 includes a screen or fan guard 34. The openings in the louvered panels 28 form an air inlet along an outdoor unit air inlet flow path I and the openings in the fan guard 34 form an air outlet O flow path.

FIG. 3 illustrates an exploded view of an example fan housing assembly 40 including the fan assembly 32 and the top cover assembly 26. The fan assembly 32 includes an electric motor 42 and a fan 44 having a plurality of airfoils 48 driven by the electric motor 42. The exemplary fan 44 may be a molded polymeric structure having a hub 46 with a socket keyed for mounting to a rotor shaft of the electric motor 42. The airfoils 48 extend radially outward from a peripheral sidewall or platform 50 of the hub 46 to corresponding distal ends or tips 52. This is distinguished from a fan having an outer diameter (OD) shroud integral with the blades.

Figure 4:
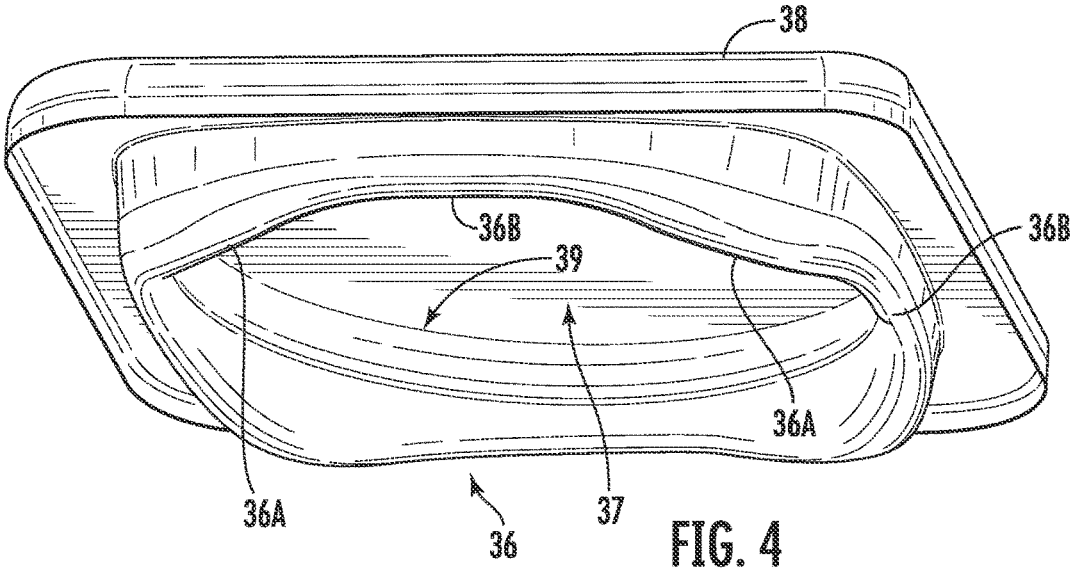
FIG. 4 is a bottom perspective view of a housing.

As shown in FIG. 4, the exemplary top cover assembly 26 includes a lower member 36 having an opening 37 to define a location for the fan assembly 32 (aka, fan shroud or unit outlet duct) surrounding the fan 44. The lower member 36 may also include protrusions or lobes 36A at the corners separated by recessed portions 36B. The top cover assembly 26 also includes an upper member 38 defining a diverging diffuser having an opening 39 with an expanding cross-sectional area. The diverging diffuser in the upper member 38 is located downstream of the fan assembly 32 and upstream of the fan guard 34.

Figure 5:
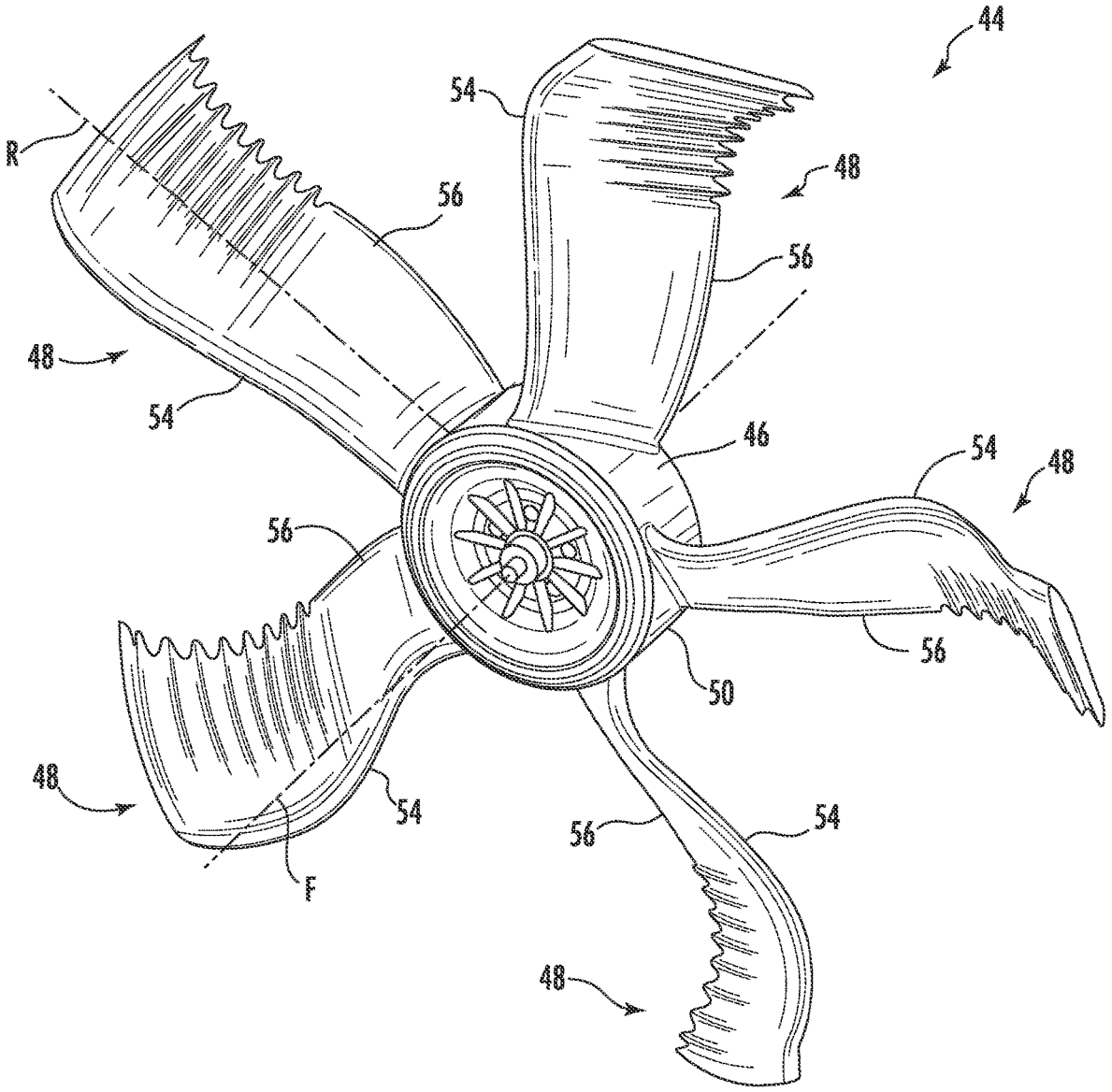
FIG. 5 is a perspective view of an example fan.

As shown in FIG. 5, the airfoils 48 extend between respective leading edges 54 and trailing edges 56. The airfoils 48 also include a pressure side surface 60 and a suction side surface 62 opposite the pressure side surface 60. The leading edge 54 and the trailing edge 56 separate the pressure side surface 60 from the suction side surface 62. The airfoils 48 also extend radially outward relative to the rotational axis F of the fan 44 from the platform 50 of the hub 46. Although the airfoils 48 shown in FIG. 5 are integral with the hub 46, the airfoils 48 could extend from individual hub segments 46A as shown in FIGS. 6-10 that can be joined together to form a complete circular hub.

Figure 6:
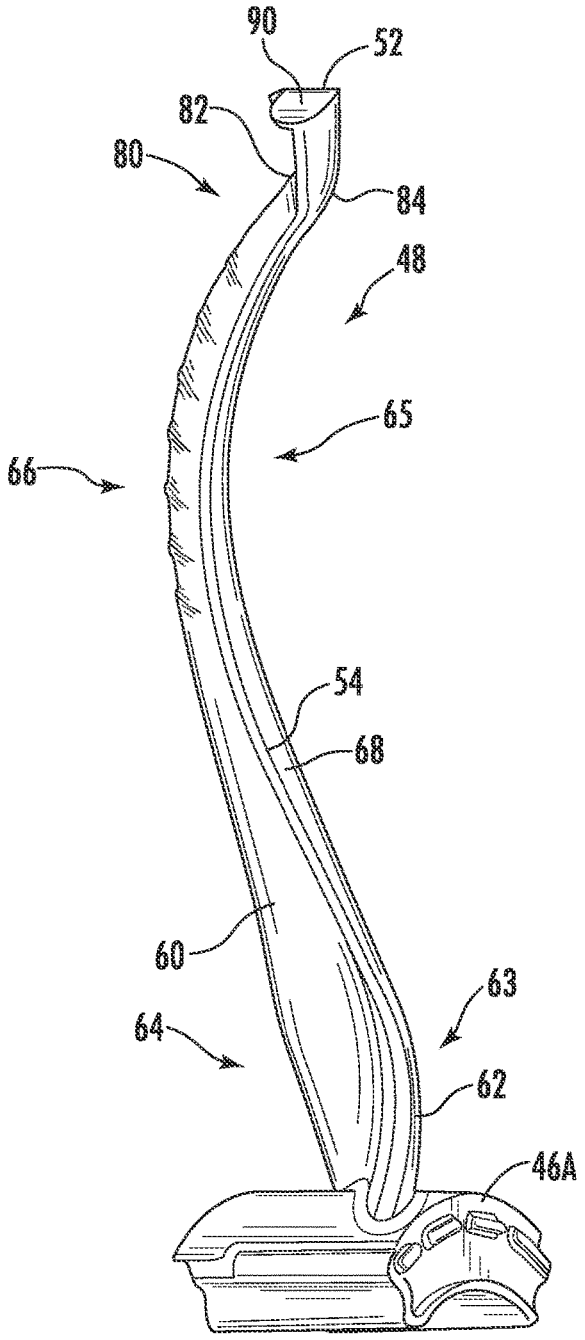
FIG. 6 is a first perspective view of a leading edge of an airfoil of the fan of FIG. 5.
Figure 7:
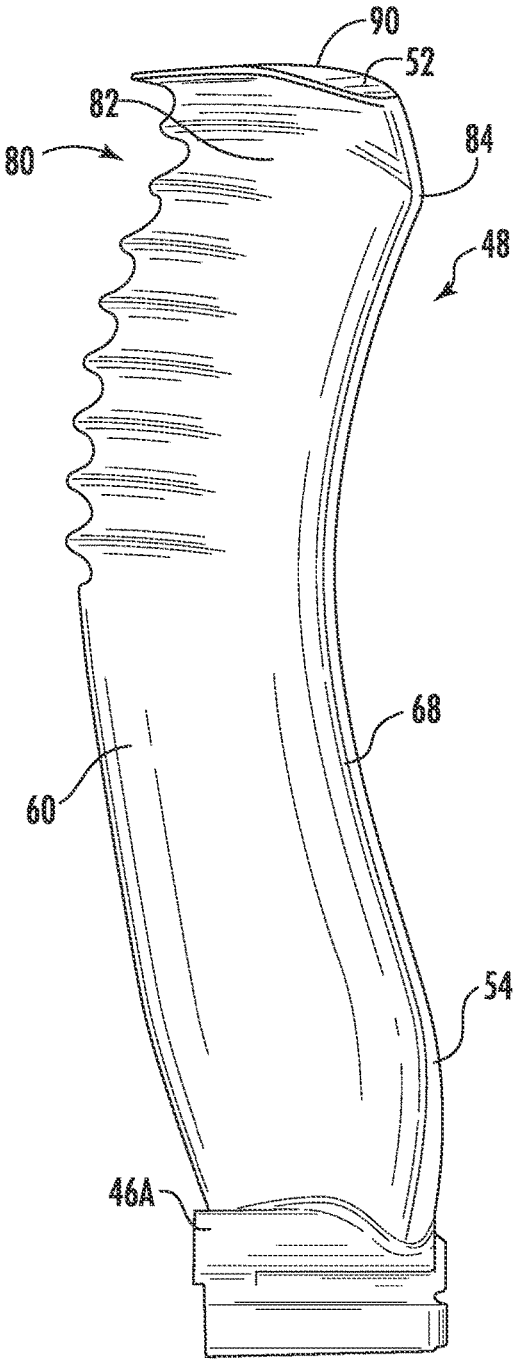
FIG. 7 is a second perspective view of the leading edge of the airfoil of the fan of FIG. 5.
Figure 8:
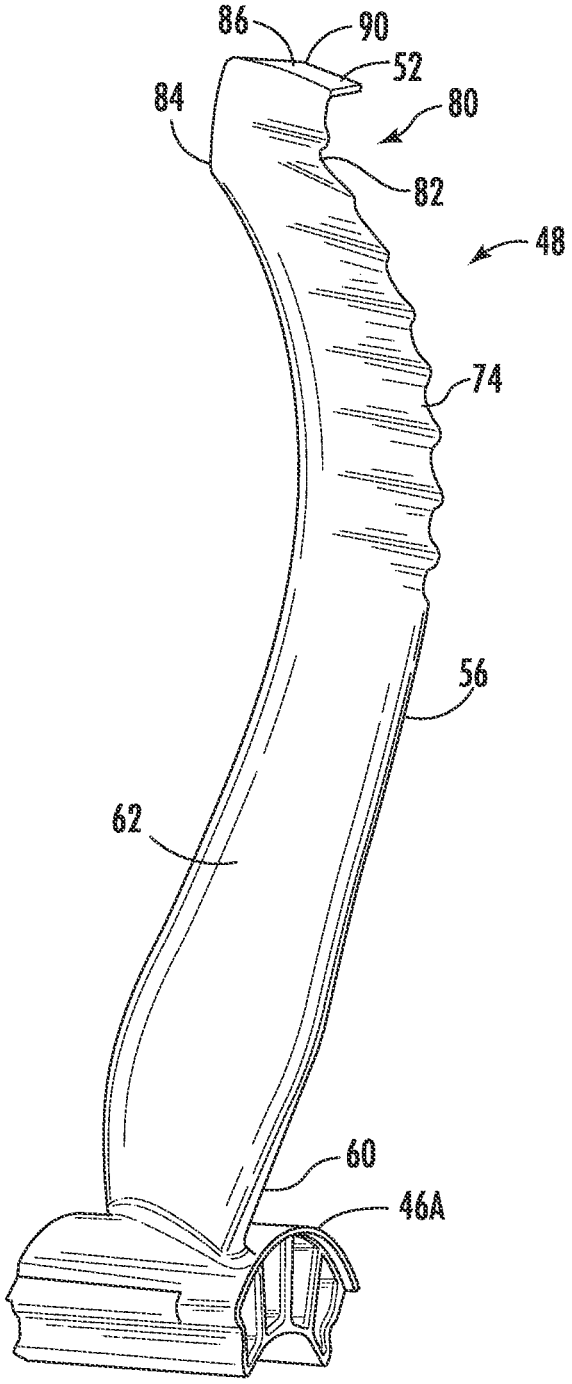
FIG. 8 is a perspective view of a trailing edge of the airfoil of the fan of FIG. 5.
Figure 11:
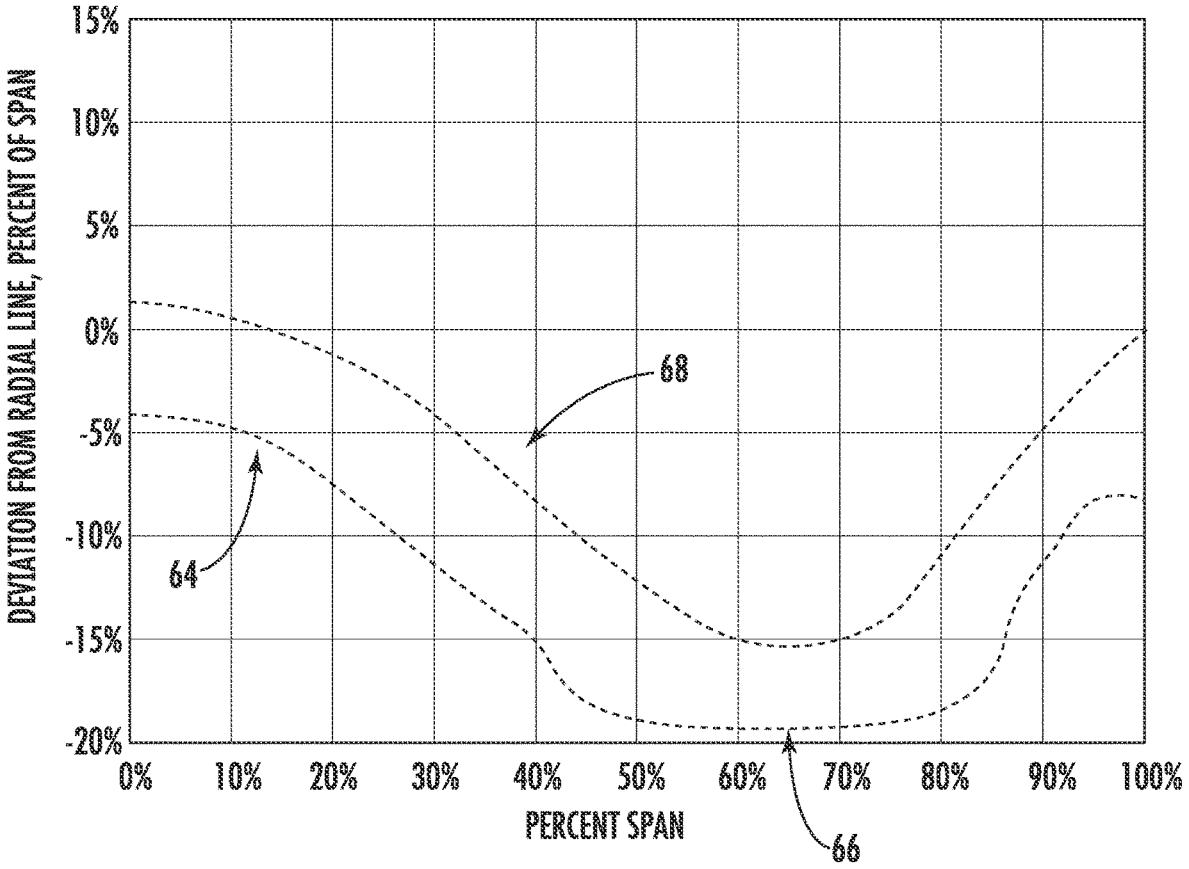
FIG. 11 illustrates a graphical representation of lean relative to a radial line of a leading edge of the airfoil of FIG. 6.

FIGS. 6 and 7 illustrate a profile of the leading edge 54 of the airfoil 48. In particular, the leading edge 54 includes at least one concave pressure side profile 64 and at least one convex pressure side profile 66. The at least one convex pressure side profile 66 defines a greatest negative deviation from a radial line R as a percentage of span as shown in FIG. 11. The radial line R includes a line extending in a radial direction through the airfoil 48 as shown in FIG. 5. In the illustrated example, the concave pressure side profile 64 is located radially inward from the convex pressure side profile 66. Furthermore, because the suction side surface 62 generally follows the profile of the pressure side surface 60 but in an opposite direction, the suction side surface 62 includes a convex suction side profile 63 that corresponds to the concave pressure side profile 64 and a concave suction side profile 65 and that corresponds to the convex pressure side profile 66.

The leading edge 54 includes an inflection point 68 between the concave pressure side profile 64 and the convex pressure side profile 66. The inflection point 68 occurs at a point along the leading edge 54 where the leading edge 54 changes direction of concavity between the concave pressure side profile 64 and the convex pressure side profile 66. A graphical representation of the lean of the airfoil 48 is shown in FIG. 11 including dashed lines representing a region having favorable aerodynamic properties that improve the efficiency of the fan assembly 32.

In the illustrated example shown in FIGS. 6-7 and 11, the inflection point 68 is located at less than 50% of a span of the airfoil 48. In another example, the inflection point 68 is located between 25% and 40% of the span of the airfoil 48. Additionally, the concave pressure side profile 64 is centered at between 10% and 30% of the span of the airfoil 48 and the convex pressure side profile 66 is centered between 45% and 85% of the span of the airfoil 48. The convex pressure side profile 66 also includes a negative deviation from the radial line of greater than 10% of the span (FIG. 11) and can include a negative deviation of between 15% and 20% of the span. The region of the leading edge 54 between the concave pressure side profile 64 and the convex pressure side profile 66 includes the greatest negative slope in the lean of the airfoil 48 (FIG. 11). Additionally, the region radially outside of the convex pressure side profile 66 includes the greatest positive slope in the leading edge 54 (FIG. 11).

Figure 9:
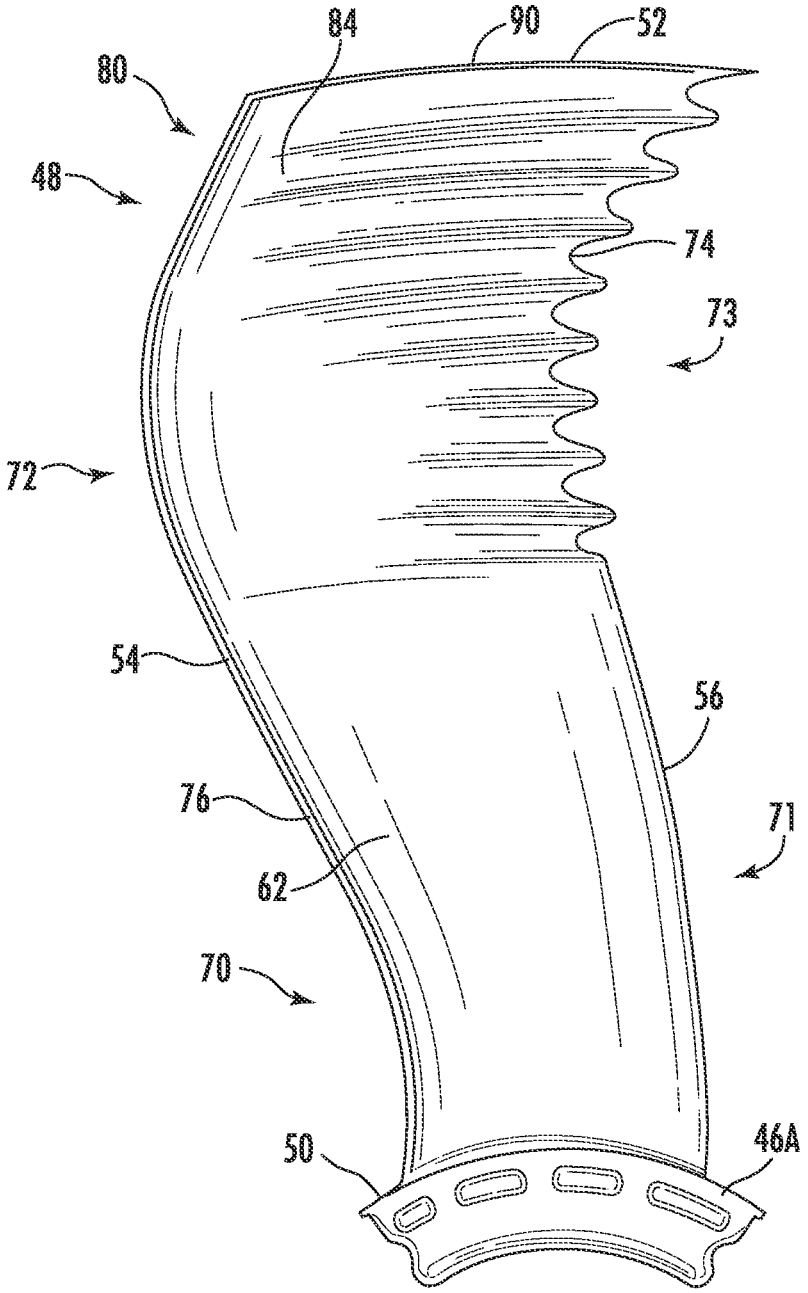
FIG. 9 is a suction side view of the airfoil of the fan of FIG. 5.
Figure 10:
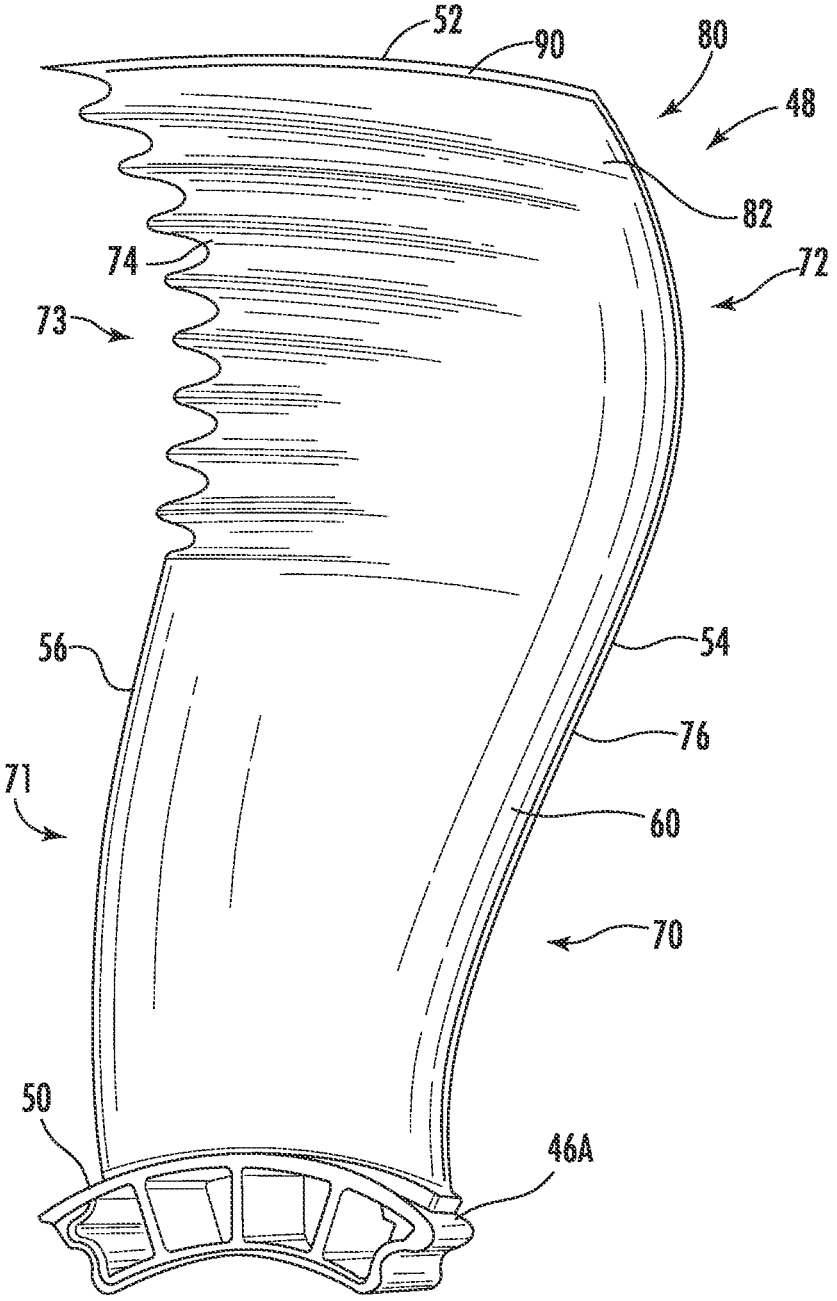
FIG. 10 is a pressure side view of the pressure side of the airfoil of the fan of FIG. 5.

As shown in FIGS. 9 and 10, the leading edge 54 also includes an alternating concavity defined in a direction of sweep of the airfoil 48. The sweep of the airfoil 48 refers to the position of the leading edge 54 relative to a radial line in a chordwise direction.

In the illustrated example, the alternating concavity of the leading edge 54 shown in FIGS. 9 and 10 includes a downstream extending concavity 70 located radially inward from an upstream extending convexity 72. The downstream extending concavity 70 and the upstream extending convexity 72 both extend in a direction relative to a radial line of the airfoil 48. Additionally, the trailing edge 56 includes a downstream extending convexity 71 that generally corresponds in shape with the downstream extending concavity 70 and an upstream extending concavity 73 that generally corresponds in shape with the upstream extending convexity 72. Furthermore, as shown in FIGS. 9-10, a chord length of the airfoil 48 generally expands between a radially inner end of the airfoil 48 and a radially outer end of the airfoil 48 or tip 52.

The leading edge 54 also includes an inflection point 76 between the downstream extending concavity 70 and the upstream extending convexity 72. The inflection point 76 occurs at a point along the leading edge 54 where the leading edge 54 changes direction of concavity between the downstream extending concavity 70 and the upstream extending convexity 72, In the illustrated example, the inflection point 76 is located at less than 50% of the span of the airfoil 48. In another example, the inflection point 76 is located between 15% and 50% of the span of the airfoil 48. Additionally, the downstream extending concavity 70 is centered at between 10% and 30% of the span of the airfoil 48 and the upstream extending convexity 72 is centered between 55% and 85% of the span of the airfoil 48.

As shown in FIGS. 6-10, the airfoil 48 also includes a tip bend 80 or kink extending between the leading edge 54 and the trailing edge 56. The tip bend 80 includes a concave profile 82 extending axially relative to the axis F along the pressure side surface 60 of the airfoil 48 and a corresponding convex profile 84 extending along the suction side surface 62 of the airfoil 48. The tip bend 80 is located radially outward from the convex pressure side profile 66. The tip bend 80 results in lower operating noise of the fan 44 during operation of the outdoor unit 20. Additionally, a tip fence 90 at least partially defines a platform 86 at the tip 52 of the airfoil 48 radially outward of the tip bend 80.

The trailing edge 56 may also include serrations 74 along a radially outer portion of the trailing edge 56. In the illustrated example, the serrations 74 are located along the trailing edge 56 between 50% and 100% of the span of the airfoil 48. Also, as shown in FIGS. 6-10, the serrations 74 are located radially outward from the inflection points 68 and 76.

The complex geometry of the airfoils 48 including the concave pressure side profile 64, the convex pressure side profile 66, the downstream extending concavity 70, and the upstream extending concavity 72 contribute to increased efficiency of the fan 44, which results in lower energy consumption for the outdoor unit 20. Furthermore, the complex geometry of the airfoils 48 directs the cooling air from the inlet I and out the outlet O in an axially upward and radial outward direction relative to the axis F shown in FIG. 1.

Figure 12:
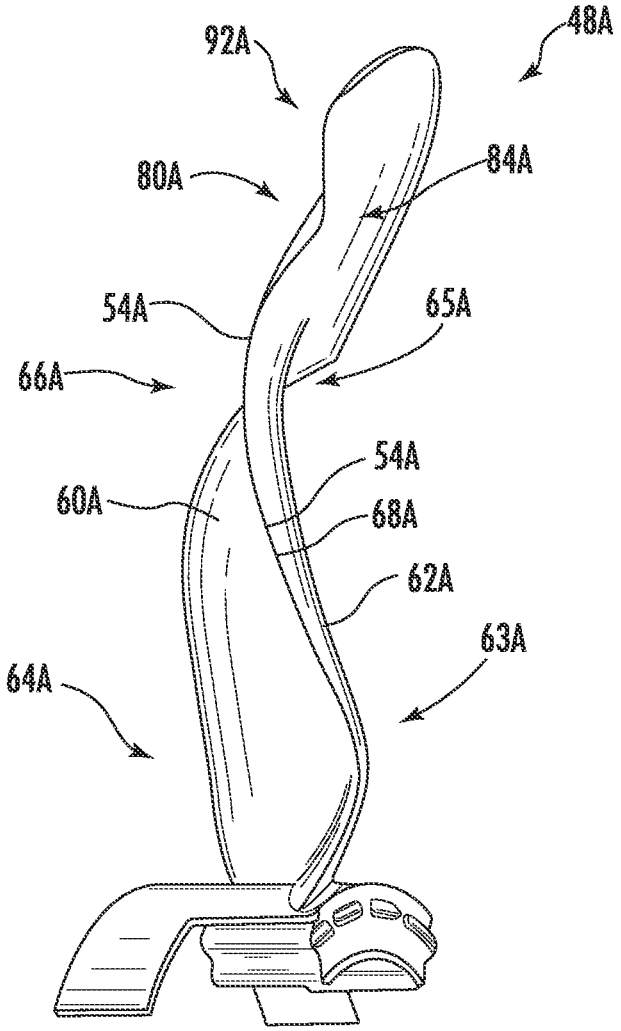
FIG. 12 is a first perspective view of a leading edge of another example airfoil.
Figure 13:
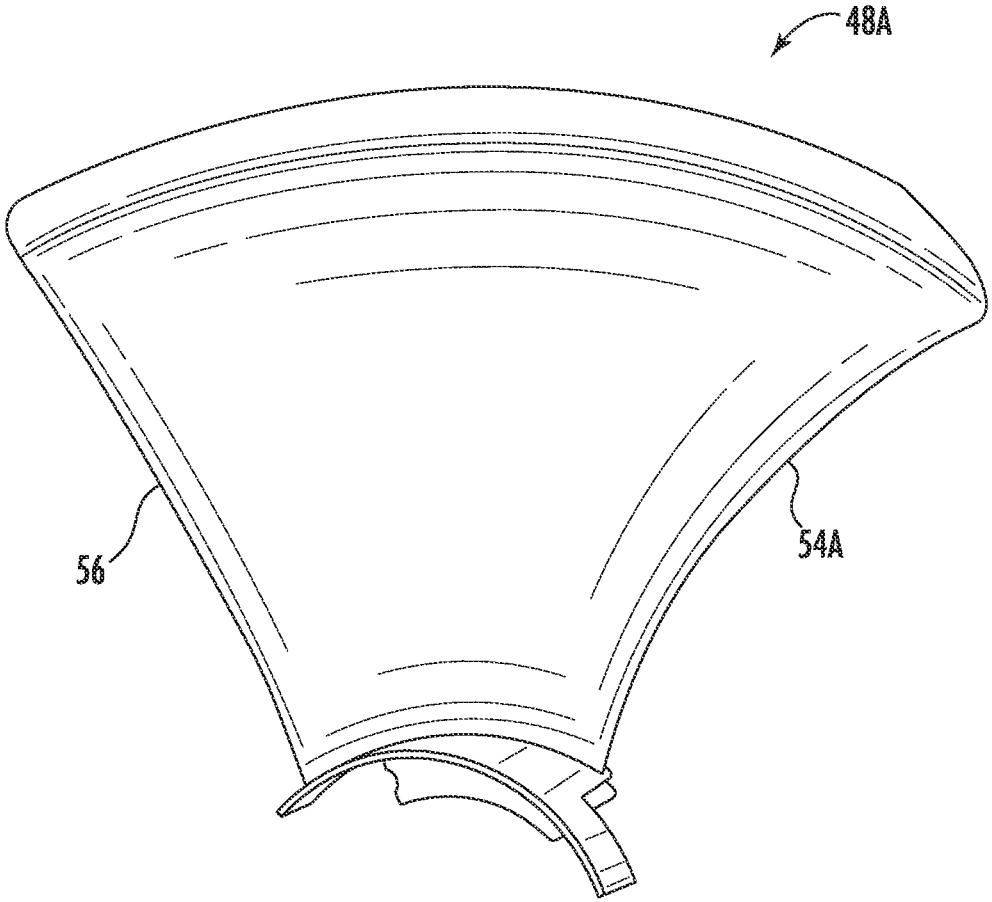
FIG. 13 is a side view of the airfoil of FIG. 12.

FIGS. 12 and 13 illustrates another example airfoil 48A similar to the airfoil 48 above except where described below or shown in the Figures. FIG. 12 illustrates a leading edge 54A of the airfoil 48A having a similar profile or lean as airfoil 48. In particular, the leading edge 54A includes at least one concave pressure side profile 64A and at least one convex pressure side profile 66A. In the illustrated example, the concave pressure side profile 64A is located radially inward from the convex pressure side profile 66A. Furthermore, because a suction side surface 62A generally follows the profile of a pressure side surface 60A but in an opposite direction, the suction side surface 62A includes a convex suction side profile 63A that corresponds to the concave pressure side profile 64A and a concave suction side profile 65A and that corresponds to the convex pressure side profile 66A.

The leading edge 54A includes an inflection point 68A between the concave pressure side profile 64A and the convex pressure side profile 66A. The inflection point 68A occurs at a point along the leading edge 54A where the leading edge 54A changes direction of concavity between the concave pressure side profile 64A and the convex pressure side profile 66A. The leading edge profile 54A is also captured in the graphical representation of the lean of the airfoil 48 shown in FIG. 11.

In the illustrated example shown in FIG. 12, the inflection point 68A is located at less than 50% of a span of the airfoil 48A. In another example, the inflection point 68A is located between 30% and 55% of the span of the airfoil 48A. Additionally, the concave pressure side profile 64A is centered at between 10% and 30% of the span of the airfoil 48 and the convex pressure side profile 66A is centered between 45% and 85% of the span of the airfoil 48A. The region of the leading edge 54A between the concave pressure side profile 64A and the convex pressure side profile 66A includes the greatest negative slope in the lean of the airfoil 48A. Additionally, the region radially outside of the convex pressure side profile 66A includes the greatest positive slope in the leading edge 54A. Furthermore, the airfoil 68A could include a linear leading edge 54A without a curvature.

The airfoil 48A also includes a tip bend 80A or kink extending between the leading edge 54A and a trailing edge 56A. The tip bend 80A includes a concave profile 82A extending axially relative to the axis F along the pressure side surface 60A of the airfoil 48A and a corresponding convex profile 84A extending along the suction side surface 62A of the airfoil 48A. The tip bend 80A is located radially outward from the convex pressure side profile 66A. The tip bend 80A results in lower operating noise of the fan 44 during operation of the outdoor unit 20. Additionally, a tip convex profile 92A is located radially outward from the tip bend 80A and includes a convex profile in the leading edge 54A relative to the pressure side surface 60A.

Furthermore, as shown in FIG. 13, the airfoil 48A includes a substantially different sweep when compared to the airfoil 48. In particular, the airfoil 48A includes a generally increasing dimension from a radial line such that a radially outer end of the airfoil 48A includes a dimension between 2-3 times a dimension at the root portion.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A fan for a climate control outdoor unit comprising:

a plurality of airfoils located around a central hub, wherein each of the airfoils includes:

a leading edge;

a trailing edge opposite the leading edge;

a pressure side surface extending between the leading edge and the trailing edge; and a suction side surface opposite the pressure side surface and extending between the leading edge and the trailing edge, wherein the leading edge includes a greatest negative deviation from a radial line of greater than 10% of a span of the airfoil and the greatest negative deviation is located at between 45% and 85% of the span of the airfoil.

2. The fan of claim 1, wherein the greatest negative deviation from the radial line is greater than 15% of the span.

3. The fan of claim 2, wherein the greatest negative deviation from the radial line is located at between 60% and 80% of the span.

4. The fan of claim 1, wherein the airfoil at 0% of the span of the airfoil includes a negative deviation from the radial line of between 0% and 5% of the span of the airfoil.

5. The fan of claim 1, wherein the greatest negative deviation defines a convex profile of the leading edge with respect to the pressure side surface and the leading edge includes a concave profile with respect to the pressure side surface located adjacent the central hub.

6. The fan of claim 5, wherein the concave profile of the leading edge is centered at between 10% and 30% of the span of the airfoil.

7. The fan of claim 5, wherein the leading edge includes a downstream extending concavity and an upstream extending concavity and the downstream extending concavity is located radially inward of the upstream extending concavity.

8. The fan of claim 7, wherein an inflection point between the downstream extending concavity and the upstream extending concavity is located at between 15% and 50% of the span of the airfoil.

9. The fan of claim 1, wherein the airfoil includes a tip fence extending between the leading edge and the trailing edge of the airfoil having a concave profile extending along the pressure side surface of the airfoil.

10. The fan of claim 1, wherein a tip section located outward of 90% of the span of the airfoil includes a negative deviation of between 5% and 10% of the span from the radial line.

11. The fan of claim 1, wherein the fan is a molded polymeric structure with the central hub and the central hub includes a socket keyed for mounting to a rotor shaft.

12. A fan housing assembly comprising:

a housing defining an inlet and a diffuser located fluidly downstream of the inlet;

a fan located within the fan housing and having a plurality of airfoils located around a central hub, wherein each of the airfoils includes:

a leading edge;

a trailing edge opposite the leading edge;

a pressure side surface extending between the leading edge and the trailing edge; and a suction side surface opposite the pressure side surface and extending between the leading edge and the trailing edge, wherein the leading edge includes a greatest negative deviation from a radial line of greater than 10% of a span of the airfoil and the greatest negative deviation is located at between 45% and 85% of the span of the airfoil.

13. The assembly of claim 12, wherein the diffuser is a diverging diffuser and the inlet includes a plurality of lobes fluidly upstream of the fan and separated by a corresponding recessed portion with the plurality of lobes and the corresponding recessed portion defining a leading edge of the inlet.

14. The assembly of claim 12, further comprising a downstream extending concavity along the leading edge of the airfoil and an upstream extending concavity along the leading edge of the airfoil and the downstream extending concavity is located radially inward of the upstream extending concavity.

15. The assembly of claim 14, wherein the greatest negative deviation from the radial line is greater than 15% of the span and a tip section located outward of 90% of the span of the airfoil includes a negative deviation of between 5% and 10% of the span from the radial line.

16. The assembly of claim 15, wherein the greatest negative deviation from the radial line is located at between 60% and 80% of the span.

17. The assembly of claim 12, wherein the airfoil at 0% the span of the airfoil includes a negative deviation from the radial line of between 0% and 5% of the span of the airfoil.

18. The assembly of claim 12, wherein the greatest negative deviation defines a convex profile of the leading edge with respect to the pressure side surface and the leading edge includes a concave profile with respect to the pressure side surface located adjacent the central hub.

19. The assembly of claim 18, wherein the concave profile of the leading edge is centered at between 10% and 30% of the span of the airfoil.

20. The assembly of claim 12, wherein the airfoil includes a tip fence extending between the leading edge and the trailing edge of the airfoil having a concave profile extending along the pressure side surface of the airfoil.

21. The assembly of claim 12, wherein a tip section located outward of 90% of the span of the airfoil includes a negative deviation of between 5% and 10% of the span from the radial line.

22. The assembly of claim 12, wherein the fan is a molded polymeric structure with the central hub and the central hub includes a socket keyed for mounting to a rotor shaft.

* * * * *